US007882814B2

(12) United States Patent
Spath et al.

(10) Patent No.: US 7,882,814 B2
(45) Date of Patent: Feb. 8, 2011

(54) INNER ARM STOP FOR A SWITCHABLE ROCKER ARM

(75) Inventors: Mark J. Spath, Spencerport, NY (US); Nick J. Hendriksma, Grand Rapids, MI (US); Michael E. McCarroll, West Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 414 days.

(21) Appl. No.: 12/074,277

(22) Filed: Mar. 3, 2008

(65) Prior Publication Data

US 2009/0217895 A1 Sep. 3, 2009

(51) Int. Cl.
*F01L 1/18* (2006.01)

(52) U.S. Cl. ..... 123/90.39; 123/90.44; 74/559

(58) Field of Classification Search ..... 123/90.39, 123/90.44; 29/888.2; 74/559, 567, 569
See application file for complete search history.

(56) References Cited

U.S. PATENT DOCUMENTS

| | | | |
|---|---|---|---|
| 5,544,626 | A | 8/1996 | Diggs et al. |
| 5,653,198 | A | 8/1997 | Diggs |
| 5,657,726 | A | 8/1997 | Diggs |
| 5,960,755 | A | 10/1999 | Diggs et al. |
| 6,314,928 | B1 | 11/2001 | Baraszu et al. |
| 6,532,920 | B1 | 3/2003 | Sweetnam et al. |

FOREIGN PATENT DOCUMENTS

WO WO 2007/017027 A1 2/2007

*Primary Examiner*—Ching Chang
(74) *Attorney, Agent, or Firm*—Thomas N. Twomey

(57) ABSTRACT

A roller finger follower assembly for variably activating a valve in an internal combustion engine includes at least one vertical recessed channel formed inside an outer arm and a shaft. The channel includes a machined upper surface closing the channel. The shaft engages with the recessed channel, the shaft reciprocates within the recessed channel, and the upper surface stops an upward movement of the shaft.

18 Claims, 4 Drawing Sheets

INNER ARM STOP FOR A SWITCHABLE ROCKER ARM

TECHNICAL FIELD

The present invention relates to mechanisms for altering the actuation of valves in internal combustion engines; more particularly, to a switchable rocker arm such as a roller finger follower capable of changing between high and low or no valve lifts; and most particularly, to a stop for limiting the upward travel of an inner arm of a switchable rocker arm.

BACKGROUND OF THE INVENTION

Variable valve activation (VVA) mechanisms for internal combustion engines are well known. It is known to lower the lift, or even to provide no lift at all, of one or more valves of a multiple-cylinder engine, during periods of light engine load. Such valve deactivation or valve lift switching can substantially improve fuel efficiency.

A Roller Finger Follower (RFF), as a type of rocker arm, acts between a rotating eccentric camshaft lobe and a pivot point on the engine, such as a Hydraulic Lash Adjuster (HLA), to open and close an engine valve. Switchable RFFs may be a "deactivation" type or a "two-step" type. The term switchable deactivation RFF, as used herein, means the switchable RFF is capable of switching from a valve lift mode to a no lift mode. The term switchable two-step RFF, as used herein, means the switchable RFF is capable of switching from a first valve lift mode to a second and lesser valve lift mode that is greater than no lift. When the term "switchable RFF" is used herein, by itself, it includes both types.

A typical switchable RFF includes an outer arm and an inner arm. The inner arm is movably connected to the outer arm. It can be switched by a locking member, from a coupled mode wherein the inner arm is immobilized relative to the outer arm, to a decoupled state wherein the inner arm can move relative to the outer arm. Typically, the outer arm of the switchable RFF is pivotally supported at a first end by the HLA. A second end of the outer arm operates against an associated engine valve for opening and closing the valve by the rotation of an associated eccentric cam lobe acting on an inner arm contact surface which may be a roller. The inner arm is connected to the outer arm for pivotal movement about the outer arm's second end with the contact surface of the inner arm disposed between the first and second ends of the outer arm. Typically, the locking member includes a locking pin disposed in a bore in the first end of the outer arm, the locking pin being selectively moved to engage the inner arm to thereby couple the inner arm to the outer arm when engaged, and decouple the inner arm from the outer arm when disengaged.

In a switchable two-step RFF, the outer arm typically supports a pair of rollers carried by a shaft. The rollers are positioned to be engaged by associated low-lift eccentric cam lobes that cause the outer arm to pivot about the HLA, thereby actuating an associated engine valve to a low-lift. The inner arm, in turn, is positioned to engage an associated high-lift eccentric cam lobe sandwiched between the aforementioned low-lift lobes. The switchable two-step RFF is then selectively switched between a coupled and a decoupled mode by the locking member. In the coupled mode, with the inner arm locked to the outer arm, the rotational movement of the central high-lift lobe is transferred from the inner arm, through the outer arm to cause pivotal movement of the RFF about the HLA, which, in turn, opens the associated valve to a high-lift. In the decoupled mode, the inner arm is no longer locked to the outer arm and is permitted to move relative to the outer arm against a lost motion spring that biases the inner arm away from the outer arm. In turn, the rollers of the outer arm engage their associated low-lift lobes. The rotational movement of the low-lift lobes is transferred directly through the outer arm, and the associated valve is reciprocated by the outer arm to a low-lift.

A switchable deactivation RFF typically includes an outer arm and an inner arm. The inner arm supports a roller carried by a shaft. The roller is engaged by an eccentric lifting cam lobe for actuating an associated engine valve. Like the switchable two-step RFF, the switchable deactivation RFF is selectively switched between a coupled and a decoupled mode by a movable locking member. In the coupled mode the inner arm of the switchable deactivation RFF is locked to the outer arm and the rotational movement of the associated lifting cam lobe is transferred from the inner arm, through the outer arm to cause pivotal movement of the RFF about the HLA, which, in turn, opens the associated valve to a prescribed lift. In the decoupled mode, the inner arm becomes unlocked from the outer arm and is permitted to pivot relative to the outer arm against a lost motion spring. In the decoupled mode, the rotational movement of the lifting cam lobe is absorbed by the inner arm in lost motion and is not transferred to the outer arm. Thus, the associated valve remains closed when the switchable deactivation RFF is in its decoupled mode.

In a first switchable deactivation RFF design, the inner arm makes contact with an associated cam lobe while the outer arm does not. The lost motion spring biases the inner arm away from the outer arm and, with the outer arm supported by the HLA, serves to load the inner arm against its associated cam lobe in the decoupled mode. In a switchable deactivation RFF having a lost motion spring with an effective force exerted on the HLA that is higher than the opposing force of an associated HLA spring, the opposing forces must be properly managed to prevent reactive pump-down of the HLA induced by the force of the lost motion spring. For this purpose, an expansion travel limiter is incorporated in the switchable deactivation RFF to limit the movement of the inner arm relative to the outer arm. Thus, when the switchable deactivation RFF is in its decoupled mode, and the inner arm of the RFF follows the cam lobe, the lost motion spring will push the outer arm until the expansion travel limiter is engaged. At that point, further movement of the outer arm relative to the inner arm ceases, HLA pump-down is prevented and HLA leak-down recovery is initiated. Moreover, at that point, since the effective preload force of the lost motion spring is greater than the expansion force of the HLA, pump-up of the HLA is prevented. Note also that, when the inner arm of the RFF follows the base circle of the associated cam lobe, the expansion travel limiter further serves to set a clearance gap or mechanical lash between the locking pin and the inner arm to assure proper alignment of the locking pin with the inner arm when the RFF switches between its decoupled and coupled modes and to define the total mechanical lash in the valve train.

In an alternate switchable deactivation RFF design, in order to increase its resistance to HLA pump-up beyond that provided by the installed load of the lost motion spring, null pads may be added on the outer arm of the switchable deactivation HLA for contacting zero-lift, constant radius null lobes disposed on either side of the associated lifting lobe. In this design, when the inner arm contacts the expansion travel limiter, the inner arm of the RFF is prevented from contacting the base circle of its associated cam lobe by the null pads first contacting with the zero-lift null lobes. Since the inner arm is held away from the base circle of the cam by the expansion travel limiter, the force of the lost motion spring cannot pump-down the HLA. By the null pads making contact with the zero-lift null pads, pump-up of the HLA is prevented by the opposing installed load of the associated valve closing spring. The expansion travel limiter establishes the mechanical lash between the locking pin and the inner arm; as well as the clearance (lash) between the inner arm and the base circle of the cam. The pin lash plus the cam lash establishes the total mechanical lash of the valve train.

Various lost motion expansion limiters used in switchable RFFs are known in the art. For example, in U.S. Pat. No. 6,532,920, a switchable two-step RFF is shown wherein the roller shaft of the outer arm contacts a throughbore in the inner arm to limit inner arm travel. As shown in U.S. Pat. Nos. 5,544,626, 5,653,198 and 6,314,928, bumper pads or projections formed at the lower end of the inner arm are used to limit inner arm travel of the switchable RFFs. The disadvantage of these devices in the prior art is that the stop position cannot be precisely controlled resulting in sometimes too small or too large of a mechanical lash between the locking pin and the inner arm or, in the case of a switchable deactivation RFF with null pads, resulting in a clearance between the inner arm and base circle of the associated cam lobe that is too too small, or even non-existing. A mechanical lash that is too small may result in the locking pin being unable to reliably engage the inner arm. A lash that is too large may permit excess pump-down of the HLA thereby delaying the opening point, decreasing the lift and advancing the closing point of the associated valve in the coupled mode which is known to contribute to engine roughness at idle and/or emission problems. A cam clearance that is too small (in the case of a switchable deactivation RFF with null pads), between the inner arm and its base circle, increases total lash when the inner arm is allowed to contact the cam base circle and may similarly affect the opening, closing and lift characteristics of its associated valve.

What is needed in the art is a device that precisely limits the amount of upward pivotable movement of the inner arm relative to the outer arm caused by the force of the lost motion spring.

It is a principal object of the present invention to provide an inner arm stop to precisely position the inner arm relative to the outer arm thereby controlling mechanical lash and HLA pump-down.

SUMMARY OF THE INVENTION

Briefly described, a switchable RFF includes a pivotable and therefore decoupleable inner arm positioned central to an outer arm. In one aspect of the invention, a roller is carried by a shaft that is supported by the inner arm. The shaft may be free to axially rotate relative to the inner arm. A lost motion spring acts between the inner arm and the outer arm. In one embodiment, the shaft is a stepped shaft that includes a major diameter for carrying the roller and a reduced diameter portion at each end. Each of the shaft ends reciprocates in recessed channels formed inside the outer arm, under the force of the lost motion spring, when a latching mechanism is in a disengaged position and the inner arm is decoupled and, therefore, in lost motion. The movement of the shaft within the channels, and thus the roller and the inner arm, is limited when the ends of the shaft contact an end surface of the recessed channels.

The recessed channels and the end surface of each channel may be formed in many ways. For example, the recessed channels and end surfaces may be cast in the case of an investment cast outer arm, machined, stamped, cast and coined, cast and machined, or formed using electrical discharge machining. In one aspect of the invention, a cast channel includes a transverse hole formed at the upper end of the channel such as by machining or punching, so that the stopped position of the shaft, and thus the roller and inner arm, is located simply and accurately by the formed hole.

In one aspect of the invention, the channel width is less than the major diameter of the shaft and greater than the diameter of the end portion. Shoulders formed between the major diameter of the shaft and the reduced diameter portions are in close alignment with inside surfaces of the outer arm such that the axial shaft position is limited by contact between the shoulders and the inside surfaces of the outer arm. In the case where the shaft is free to axially rotate relative to the inner arm, this holds the shaft in a relatively centered position. In one aspect of the invention, it also prevents the reduced diameter portions of the shaft from getting caught on the through holes formed in the outer arm.

Since it is desired to precisely control a final stopped position of the inner arm roller relative to the outer arm, the tolerance variation of the stopped position of the roller is minimized by the construction in accordance with the invention. In one aspect of the invention, by controlling the size and position of the outer arm through holes, the stopped position of the roller can be maintained with precise control.

In accordance with the invention, in the case where the roller shaft is free to rotate relative to the inner arm, the invention requires no staking or clips to assemble the shaft to the inner arm. This reduces manufacturing cost, minimizes distortion caused by the staking, and reduces wear on all shaft surfaces by distributing the shaft loads over greater areas of contact.

In an alternate embodiment in accordance with the present invention, the reduced diameter portions of the shaft may be designed to be temporarily collapsible into the major diameter portion of the shaft during assembly, such that the inner arm can be readily assembled to the outer arm from the top.

BRIEF DESCRIPTION OF THE DRAWINGS

These and other features and advantages of the invention will be more fully understood and appreciated from the following description of certain exemplary embodiments of the invention taken together with the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
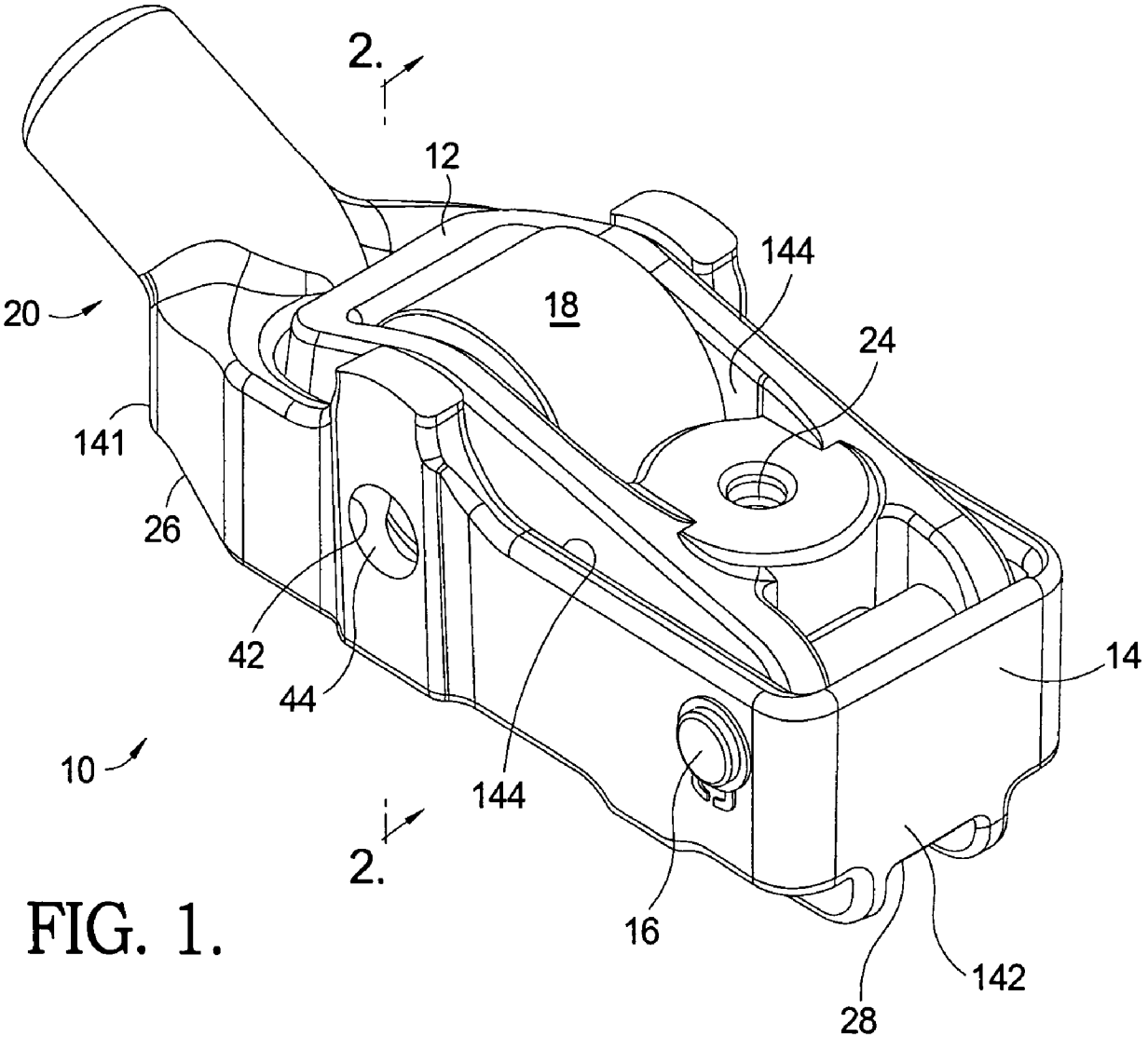
FIG. 1 is an isometric view of a deactivation roller finger follower assembly in accordance with the invention.
Figure 2:
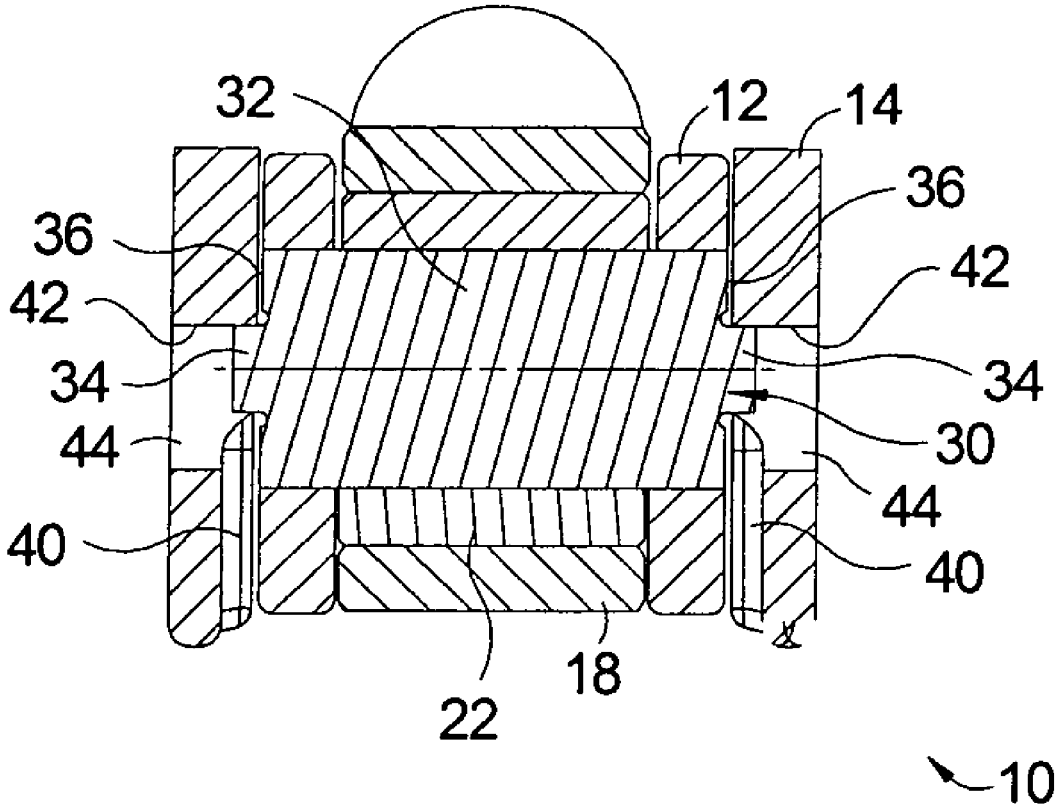
FIG. 2 is a cross-sectional view of the deactivation roller finger follower taken along line 2-2 in FIG. 1 in accordance with the invention.

Referring to FIGS. 1 and 2, a deactivation RFF assembly 10 in accordance with the invention is illustrated. While this invention is described in the context of a switchable deactivation RFF, it should be understood that the inner arm stop as described below may be applied to a switchable two-step RFF as well.

Switchable deactivation RFF assembly 10 includes an inner arm 12 that is pivotably and therefore deactivateably disposed in a central opening in an outer arm 14. Inner arm 12 pivots within outer arm 14 about a pivot shaft 16. Inner arm 12 includes a contact surface. The contact surface may be a roller 18 carried by a shaft 30 that is supported by the inner arm 12. A bearing 22 may rotatably support roller 18 on shaft 30 for following a cam lobe of a lifting cam of an engine camshaft (not shown). Bearing 22 may be, for example, a roller or needle bearing. Shaft 30 may or may not be fixed from rotation with inner arm 12. In the case where the contact surface does not include a roller, shaft 30 may be pins extending from either side of the inner arm. Outer arm 14 includes two inside walls 144 positioned parallel to each other. A pair of recessed channels 40 is formed in inside walls 144. Channels 40 are positioned across from each other. Each channel 40 includes a dimensionally controlled end surface 42 closing channel 40 at one end. End surface 42 stops movement of shaft 30 within channels 40. Channels 40 may be open at an end opposite the described closed end. A lost motion spring 24 acts between inner arm 12 and outer arm 14 to pivot the inner arm away from the outer arm. A socket 26 for pivotably mounting RFF assembly 10 on an HLA (not shown) is included at a first end 141 of outer arm 14. A pad 28 for actuating a valve stem (not shown) is included at a second end 142 of outer arm 14. A latching mechanism 20 disposed within outer arm 14 at the first end 141 thereof selectively couples or decouples inner arm 12 to or from outer arm 14.

The switchable deactivation RFF assembly 10 is selectively switched between a coupled and a decoupled state. In the coupled state inner arm 12 and, therefore shaft 30, is coupled to outer arm 14, and rotation of the lifting cam is transferred from roller 18 through shaft 30 to pivotal movement of outer arm 14 about the HLA which, in turn, reciprocates the associated valve. In the decoupled state, inner arm 12 and, therefore shaft 30, is decoupled from outer arm 14. Thus, shaft 30 does not transfer rotation of the lifting cam to pivotal movement of outer arm 14, and the associated valve is not reciprocated. Rather, shaft 30 is reciprocated within recessed channels 40 formed inside outer arm 14. Channels 40 retain and guide reciprocation of shaft 30.

Referring to FIG. 2, in one aspect of the invention, shaft 30 may be a stepped shaft that is of a generally elongated cylindrical shape that transitions towards both ends in a step in accordance with a preferred embodiment of the invention. Shaft 30 includes a major diameter center portion 32 and a reduced diameter end portion 34 at both ends of major the diameter center portion 32. At each intersection of center portion 34 with an end portion 32, and therefore at both ends of center portion 32, a face 36 is formed. Both end portions 34 preferably have substantially the same length and diameter. The diameter of end portions 34 is smaller than a diameter of center portion 32 thereby defining face 36. Center portion 32 supports bearing 22 and roller 18 and is supported by inner arm 12, as shown in FIG. 2. Each of the reduced diameter portions 34 reciprocates in vertical recessed channels 40 due to the force of lost motion spring 24 when latching mechanism 20 is in disengaged position and inner arm 12 is decoupled from outer arm 14 and, therefore, in lost motion. The movement within channels 40 of shaft 30, and thus roller 18, is limited when reduced diameter portions 34 of shaft 30 contact end surface 42 of recessed channels 40. Shaft 30 may be made from bearing steel and may be hardened throughout. In one aspect of the invention, shaft 30 may be a solid shaft formed as an integral part whereby the shaft is installed into the assembly by first installing the roller and shaft into the inner arm, then positioning the shaft ends into the channels of the outer arm from the bottom of the outer arm. The inner arm, with the lost motion spring in place, is then attached to the outer arm at its pivot point.

In an alternate embodiment, reduced diameter end portions 34 are formed as separate pieces from major diameter center portion 32. End portions 34 may be formed to be collapsible within center portion 32 enabling assembly of inner arm 12 to outer arm 14 from the top. Collapsible end portions 34 may be configured by using a hollow straight shaft as center portion 32 and smaller solid straight shafts as end portions 34. End portions 34 may be slideably inserted into both ends of hollow center portion 32. A spring inserted between the slideable end portions 34 serves to expand the end portions 34 outward after assembly of inner arm 12 to outer arm 14. When expanded, collapsible end portions 34 will engage channels 40 inside the outer arm 14.

Figure 3:
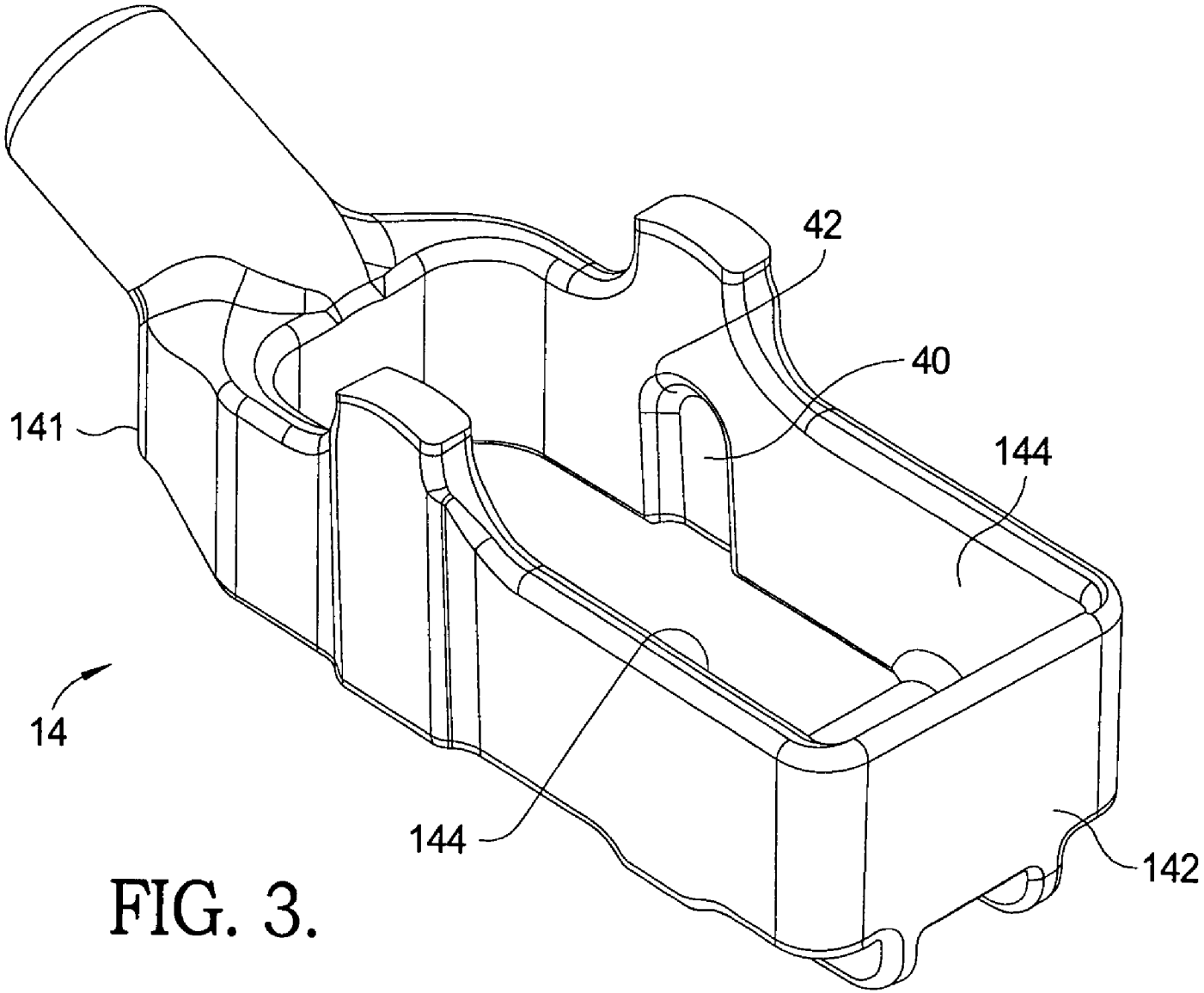
FIG. 3 is an isometric view of a cast outer arm of the deactivation roller finger follower in accordance with the invention.
Figure 4:
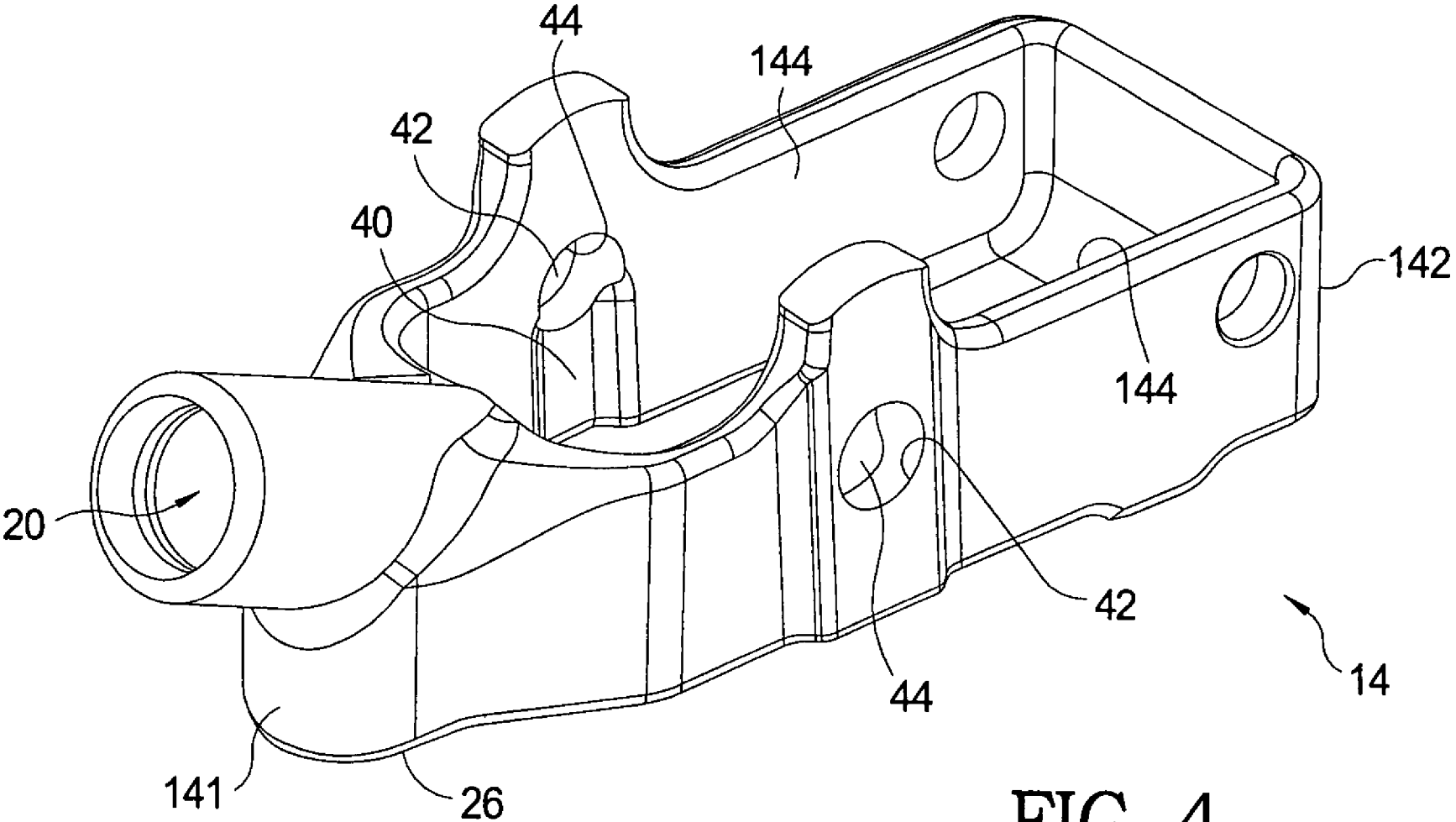
FIG. 4 is an isometric view of a cast and machined outer arm of the deactivation roller finger follower in accordance with the invention.

Referring to FIG. 3, recessed channels 40 and end surface 42 of each channel 40 may be formed integral with outer arm 14 during a casting process. To accurately position the end surface 42 at the upper end of each channel 40, in one aspect of the invention, a transverse through hole 44 may be formed into outer arm 14, such as by machining or punching, following the casting process, as illustrated in FIG. 4. The upper inside surface of through hole 44 forms end surface 42. Thus, the position of the upper inside surface of the through hole limits the upward movement in the vertical direction of the shaft and precisely controls the final stopped position of the inner arm roller relative to the outer arm. Forming through hole 44 as described enables the upward travel of the inner arm to be more precisely controlled than in the as cast embodiment. A machined hole, for example, provides a rounded circumference so that shaft 30 rests against a curved surface when making contact with end surface 42, which is known in the art to resist wear between the contact points. By setting the size and/or position of through hole 44, the stopped position of shaft 30 and roller 18 can be easily set in accordance with assembly requirements.

Thus, in accordance with the invention, end surfaces 42 may be formed by machining or punching or also, for example, by stamping, by casting and coining, or by electrical discharge machining.

Channel 40 has a width that is preferably less than the major diameter of center portion 32 of shaft 30 and greater than the diameter of end portion 34 such that at least a portion of face 36 is able to contact inside wall 144. Shaft 30 is guided by channels 40. Faces 36 in proximity with inside walls 144 of outer arm 14 hold an axially free shaft 30 in a relatively centered position within RFF 10. In the case of the embodiment shown in FIG. 4, faces 36 and inside walls 144 also prevent reduced diameter end portions 34 of shaft 30 from entering into and getting caught on through holes 44.

In the configuration described above where shaft 30 is free to rotate relative to the inner arm, retainers such as clips or staking to assemble shaft 30 to inner arm 12 are not needed.

This reduces cost, minimizes shaft distortion from staking, and reduces wear on shaft 30 by enabling the bearing or roller loads to be distributed over a greater circumferential area of shaft 30.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A switchable rocker arm assembly for variably activating a valve in an internal combustion engine, comprising:

an outer arm;

at least one recessed channel formed inside said outer arm, wherein said at least one recessed channel includes an end surface closing said channel; and a shaft associated with a contact surface of an inner arm wherein at least one end of said shaft is disposed within said at least one recessed channel wherein said at least one end of the shaft reciprocates within said at least one recessed channel, and wherein said end surface stops movement of said at least one end of said shaft.

2. The switchable rocker arm assembly of claim 1 wherein said contact surface is a roller mounted on said shaft.

3. The switchable rocker arm assembly of claim 1, further including a transverse through hole at an end of said at least one recessed channel, said through hole forming said end surface.

4. The switchable rocker arm assembly of claim 1, wherein said inner arm is pivotally and deactivateably disposed in said outer arm, said inner arm supporting said shaft, the switchable rocker arm assembly further comprising:

a lost motion spring acting between said outer arm and said inner arm; and a roller carried by said shaft.

5. The switchable rocker arm assembly of claim 1, further including a latching mechanism disposed within said outer arm that selectively couples or decouples said inner arm to or from said outer arm, and wherein said at least one end of the shaft reciprocates within said at least one recessed channel when said inner arm is decoupled from said outer arm.

6. The switchable rocker arm assembly of claim 1, wherein said shaft is a stepped shaft including a major diameter center portion and a reduced diameter end portion at least one end of said center portion.

7. The switchable rocker arm assembly of claim 6, wherein said reduced diameter end portion reciprocates in said at least one recessed channel.

8. The switchable rocker arm assembly of claim 6, wherein the at least one recessed channel has a width and wherein a diameter of said major diameter center portion of said shaft is larger than the width of said at least one recessed channel.

9. The switchable rocker arm assembly of claim 6, wherein a face is formed at the intersection of said end portion with said center portion, and wherein said face limits axial movement of said shaft.

10. The switchable rocker arm assembly of claim 1, wherein said at least one end of the shaft is free to rotate within said at least one recessed channel.

11. An inner arm stop for a switchable rocker arm assembly, comprising:

at least one recessed channel formed inside an outer arm of the switchable rocker assembly; and a transverse through hole at an upper end of said at least one recessed channel, said through hole forming an end surface closing an end of said at said at least one recessed channel;

wherein a shaft included in an inner arm reciprocates within said at least one recessed channel, and wherein reciprocating movement of said shaft is limited when said shaft contacts said end surface.

12. The inner arm stop of claim 11 wherein a roller is supported by said shaft.

13. The inner arm stop of claim 11, wherein said shaft is a stepped shaft and a solid integral piece and includes a major diameter portion and a reduced diameter portion.

14. The inner arm stop of claim 11, wherein said switchable rocker arm assembly is a deactivation roller finger follower.

15. A method for limiting upward travel of an inner arm of a switchable rocker arm, comprising the steps of:

providing at least one recessed channel in an inside wall of an outer arm of the switchable rocker arm, forming a transverse through hole into said outer arm within said at least one channel wherein an end surface of said at least one channel is formed by said through hole; and stopping movement of said inner arm by said end surface.

16. The method of claim 15, further comprising the steps of:

pivotably and deactivatably disposing said inner arm within said outer arm;

providing upward travel of said inner arm with a lost motion spring; and supporting a shaft with said inner arm wherein said shaft reciprocates within said at least one recessed channel and said shaft contacts said end surface to stop the movement of said inner arm.

17. A method of assembling a switchable rocker arm assembly having an outer arm and an inner arm wherein said inner arm is pivotably supported by the outer arm, said outer arm including a bottom end, a top end and recessed channels formed in inside walls of the outer arm, each of said recessed channels having a first end open to the bottom end of said outer arm and a second end that is closed end proximate the top end of the outer arm, comprising the steps of:

fixing a shaft transversely to said inner arm, positioning the inner arm proximate the bottom end of the outer arm, inserting opposing ends of the shaft into the first end open ends of each of said recessed channels, and moving the inner arm into the outer arm to a position to be pivotably supported by the outer arm.

18. The method of claim 17, further comprising the step of inserting the shaft in a roller.

* * * * *